US006560804B2

(12) United States Patent
Wise et al.

(10) Patent No.: US 6,560,804 B2
(45) **Date of Patent: *May 13, 2003**

(54) SYSTEM AND METHODS FOR MATTRESS CONTROL IN RELATION TO PATIENT DISTANCE

(75) Inventors: William M. Wise, Brooksville, FL (US); Cesar Z. Lina, Universal City, TX (US); X. Lu Zheng, San Antonio, TX (US); Thomas A. Boynton, Floresville, TX (US)

(73) Assignee: KCI Licensing, Inc., San Antonio, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/199,125

(22) Filed: Nov. 24, 1998

(65) Prior Publication Data

US 2001/0039681 A1 Nov. 15, 2001

Related U.S. Application Data

(60) Provisional application No. 60/066,771, filed on Nov. 24, 1997.

(51) Int. Cl.[7] ..... A47C 27/10

(52) U.S. Cl. ..... 5/713; 5/706; 5/714; 5/709; 5/905; 5/655.3; 250/23.1; 362/276; 362/318; 340/555

(58) Field of Search ..... 5/713, 710, 706, 5/654, 655.3, 714, 905, 715; 362/96, 276, 318, 802; 250/341.1, 227.14, 231.1; 340/555

(56) References Cited

U.S. PATENT DOCUMENTS 3,836,900 A 9/1974 Mansfield ..... 340/279

(List continued on next page.)

FOREIGN PATENT DOCUMENTS

EP 0 218 301 10/1986

*Primary Examiner*—Alexander Grosz

(57) ABSTRACT

The present invention relates to a system and a method for detecting and monitoring the distance between a patient and a reference point on an inflatable air mattress and for controlling the air supply to that mattress in relation to such distance. The patient distance sensing system includes a rigid support frame such as a bed frame, an inflatable air mattress positioned atop the bed frame with the upper surface of the inflatable air mattress forming a patient support surface, an air supply operable to provide controlled variations in air supply, and a series of patient distance sensing devices. Such devices including a heterodyning proximation detector, a force responsive distance sensing device, and a light responsive sensing device. Each device is operable to act separately or cooperatively in maintaining a therapeutically beneficial patient support surface through variable control of the delivery of inflation pressure to the air mattress. The heterodyning proximation detector is further operable to initiate inflation by way of a through space sensing of an approaching patient. The present invention further provides a preferred method for regulating the inflation of a therapeutic air mattress through operation of the described patient distance sensing system.

15 Claims, 3 Drawing Sheets

U.S. PATENT DOCUMENTS

| | | | | |
|---|---|---|---|---|
| 4,320,766 | A | | 3/1982 | Alihanks et al. ..... 128/671 |
| 4,542,547 | A | | 9/1985 | Sato ..... 5/715 |
| 4,694,520 | A | | 9/1987 | Paul et al. |
| 4,745,647 | A | | 5/1988 | Goodwin |
| 4,768,249 | A | | 9/1988 | Goodwin |
| 4,797,962 | A | | 1/1989 | Goode |
| 4,827,763 | A | | 5/1989 | Bourland et al. ..... 73/172 |
| 4,833,457 | A | | 5/1989 | Graebe, Jr. |
| 4,873,737 | A | | 10/1989 | Savenije |
| 4,949,412 | A | | 8/1990 | Goode |
| 4,953,247 | A | | 9/1990 | Hasty |
| 4,962,552 | A | | 10/1990 | Hasty |
| 4,989,283 | A | | 2/1991 | Krouskop |
| 5,103,519 | A | | 4/1992 | Hasty ..... 5/621 |
| 5,117,518 | A | | 6/1992 | Schild |
| 5,144,705 | A | | 9/1992 | Rogers |
| 5,148,706 | A | | 9/1992 | Masuda et al. |
| 5,182,826 | A | | 2/1993 | Thomas et al. |
| 5,189,742 | A | | 3/1993 | Schild |
| 5,267,364 | A | | 12/1993 | Volk |
| 5,560,374 | A | | 10/1996 | Viard ..... 5/611 |
| 5,625,914 | A | | 5/1997 | Schwab |
| 5,794,289 | A | | 8/1998 | Wortman et al. |
| 5,815,864 | A | | 10/1998 | Sloop |
| 5,917,180 | A | | 6/1999 | Reimer et al. |
| 5,926,883 | A | | 7/1999 | Rechin et al. |
| 6,009,580 | A | * | 1/2000 | Caminadr et al. ..... 5/713 |
| 6,145,142 | A | | 11/2000 | Rechin et al. ..... 5/706 |

* cited by examiner (Section A-A)

SYSTEM AND METHODS FOR MATTRESS CONTROL IN RELATION TO PATIENT DISTANCE

RELATED APPLICATION

This application claims the benefit of prior U.S. Provisional Patent Application Ser. No. 60/066,771 filed Nov. 24, 1997.

FIELD OF THE INVENTION

The present invention relates generally to monitoring and controlling therapeutic beds and mattress systems. More particularly, the invention relates to a system and methods for detecting and monitoring the distance between a patient and a reference point on a mattress and for controlling the mattress in relation to such distance.

BACKGROUND OF THE INVENTION

For years those who suffer from limited mobility due to age, disease or immobilizing physical condition have sought relief from decubitus ulcers, cramping and discomfort as a result of being bedridden for long periods of time. A wide range of therapeutic supports for bedridden patients, such as inflatable mattresses, mattress overlays and mattress replacements, have been made commercially available in the United States. One such support is commercially available from Kinetic Concepts, Inc. (of San Antonio, Tex.) under the "TheraKair" designation, as a mattress which provides pulsating action through inflatable support cushions as described in U.S. Pat. No. 5,267,364.

Therapeutic mattresses are often designed to reduce "interface pressures," which are the pressures that are exerted by a mattress on skin of the patient (or vice versa) while the patient is lying on the mattress. Given time, elevated interface pressures can reduce local blood circulation around the skin and, as a result, may contribute to bedsores and other complications. With inflatable mattresses, as the inflation air pressure decreases, a patient's susceptibility to encountering elevated interface pressures also tends to decrease, thereby reducing the likelihood that the patient will develop bedsores.

A problem with deflation, however, is the increased risk of "bottoming-out", which is a widely known effect where the upper surface of an air mattress converges and comes into direct contact with the lower surface. Bottoming out can negate much of the benefit of an air mattress by increasing the patient's pressures at the point of bottoming-out and, therefore, increase the risk of bedsores. Abrupt bottoming-out, such as when the patient is initially positioned on the mattress, could increase the risk of further injury to an already frail, bedridden patient. There has been a long felt need to have an inflatable mattress which self-adjusts the air pressure in inflatable cushions for optimal therapeutic purposes while significantly diminishing the risks of bottoming-out.

Some concepts of regulating air supply within a mattress for the prevention of bedsores and some concepts for the mitigation of bottoming-out effects are known. For example, U.S. Pat. No. 4,694,520 describes methods for detecting inadequate inflation while the patient is situated on the mattress. By contrast, the present invention detects the patient not only when positioned on the bed but also before the patient is even placed on the bed, thereby preventing the risks of rapid bottoming-out by "pre-inflating".

U.S. Pat. No. 4,873,737 provides for the detection of mattress thickness to supply a mean air pressure while the patient is situated thereon.

U.S. Pat. Nos. 4,745,647 and 4,768,249 provide force activated sensors to detect whether a patient has bottomed-out on a mattress but does not contemplate detecting the patient as the patient nears the bed.

U.S. Pat. No. 4,542,547 provides for mattress inflation through the detection of reflected and pulsed light while the present invention, by contrast, detects diffuse light.

SUMMARY OF THE INVENTION

It is an object of the present invention to enhance patient care and to overcome the obstacles and inadequacies of the prior art.

The present invention includes features and/or components that have been invented or selected for their individual and combined benefits and superior performance as an apparatus and a method for minimizing patient interface pressures by sensing patient distance and, if necessary, adjusting that distance to some predetermined or calculated level to optimize the therapeutic effects of the patient's mattress. The system is a combination of components and methods that together have new and novel features. Each of the individual components work in association with the others and are optimally mated for performances.

The present invention circumvents current laborious requirements of manually adjusting a mattress for optimal therapeutic inflation or allowing a patient to be filly positioned on the bed before sensing means are activated. The present invention offers a unique "hands-free" approach to controlling a mattress's air supply while a patient is lying thereon. Through the use of a heterodyning proximation detector similar benefits are achieved even before a patient lies upon the mattress. With such benefits there is less need for extra personnel and training costs to operate a mattress's air supply system. In addition, the present invention further reduces any risks for rapidly bottoming-out as a patient is initially placed on a mattress. Accordingly, the heterodyning proximation detector detects a patient as the patient nears a mattress and allows for air supply in the mattress to be increased before the patient is ever positioned atop the mattress.

The heterodyning proximation detector is an improved version of a somewhat obscure musical instrument that had been developed in the United States during the 1920s called a "Theremin". The present invention improves on the musical instrument's ability to sense a human's natural reactance, or electrical characteristics, and applies this improvement to therapeutically regulating an air mattress. The heterodyning proximation detector is effectively an antenna referenced to a conducting plate with a large surface area that variably responds to the dielectric constants of different materials. The heterodyning proximation detector may also be used to control air supply while the patient is on the mattress along with, or separately from, a force-responsive distance sensing apparatus or a light-responsive distance sensing apparatus, thus reducing the risks for gradual bottoming-out as well.

Aspects of the present invention feature a force-responsive distance sensing apparatus for continuously determining how high the patient is being supported on the mattress in real-time while the patient is on the mattress. The depth that the patient sinks into the mattress is used for controlling air supply to the mattress. The patient's height (or depth) distance is represented as variations in height of a compliant, force transmitting member that is placed relative to the mattress. Thus, a change in height of the patient generates a change of force applied to a force sensitive component coupled to the force transmitting member.

Other aspects of the present invention relate to a light-responsive distance sensing apparatus using either visible light or infrared radiation. The mattress upon which the patient rests may be physically divided into sections, such as independently inflatable air-cells, or logically divided into sections, where no physical barrier isolates the air inside the mattress. A section, logical or physical, of the mattress's initial shape becomes deformed in response to a patient being set atop the air mattress. A light emitter and light detector are situated in a fashion such that a deformation in the mattress shape reduces the amount of light that reaches the detector from the emitter, thereby generating a control signal to adjust the air pressure within the mattress accordingly. The preferred embodiments contain certain elements which include, but are not limited to:

- a frame for supporting a mattress;
- a therapeutic mattress set upon the frame where both frame and mattress cooperate in tandem to define a therapeutic bed;
- a controlled air supply for selectively inflating one or multiple air cells upon receiving data relating directly or indirectly to the height of the patient relative to the bottom of the air mattress.

In one preferred embodiment, a heterodyning proximation detector is significantly influenced by the reactance of certain objects within a known distance of the detector. Such an embodiment depends on the electrical signature left by the particular dielectric constant of that object and the field pattern of the heterodyning proximation detector. In particular, the heterodyning proximation detector is either a conducting plate or wire referenced to a ground plane that is responsive to a body's natural reactance and, thus, functions as an antenna. The antenna is variably connected to a tank circuit having a capacitor and a variable inductor. A frequency oscillator is operatively connected to the tank circuit as well. Thus, as a body nears the antenna, the body's reactance changes the electrical fields induced into the antenna, resulting in a change in the natural frequency of the oscillator. Accordingly, the frequency signal ultimately generated by the heterodyning proximation detector is used by control circuitry to create a signal which, in turn, controls a blower or regulating valve. The blower is then connected to at least one of the air cells or sections that comprise the mattress. Another embodiment of the apparatus contemplates an array of air cells each with a heterodyning proximation detector and a blower or regulating valve that is responsive to the individual reactance signatures emitted by particular segments of the body.

One embodiment includes a force-responsive distance sensing apparatus. The force-responsive distance sensing apparatus comprises a force transmitting member and a force sensing element, which might be a force-sensitive resistor, piezoelectric crystal, or the like, coupled with the force transmitting member. In operation, the force-responsive distance sensing apparatus is placed relative to the mattress so that it is responsive in real-time to the compressive forces that are continuously generated by the patient when the patient is on the mattress. When a patient lying on the mattress has compressed it to the point of bottoming, the force transmitting member is subjected to the maximum amount of loading that is exerted by the patient on the mattress, whereas an uncompressed, fully inflated mattress signifies minimum or no loading on the force transmitting member. In turn, a force sensing element that is coupled to the force transmitting member detects a range of height distance in real-time as a variable range of compression exerted thereon by the force transmitting member. However, compression of the force transmitting member is not necessarily linearly scaled between the maximum and minimum distances of the patient relative to frame; e.g., compressive forces from the force transmitting member might not be generated until the mattress thickness is compressed to some predetermined ratio of the original thickness.

Ultimately, a resulting signal from the force sensing element that is related to the compressive forces exerted on the element of the force transmitting member is sent to a controller and compared to a preset calibrating signal. The signal is then converted into a control signal which is sent to a blower or regulating valve. The controller might also be set to work with a microprocessor to store and compare various voltage values.

One embodiment includes a light-responsive distance sensing apparatus. The light-responsive distance sensing apparatus comprises a deformable container, inflatable chamber, or the like, having a sealed inner surface that is constructed of light diffusing material. A light emitter and a light detector are attached to the air cell at different locations. In operation, as a patient is set atop the air mattress, the initial shape of the air cell becomes deformed due to the compressive forces exerted by the patient thereon. Thus, any deformation of the container's inner surface between the light emitter and light detector would scatter light so that, ultimately, less light would be received and detected by the light detector than what light was initially emitted when the air cell was not subject to compressive forces. The resulting output signal from the light detector is sent to a controller and compared to a calibrated reference signal. The controller may then emit a control signal that indicates a significant disparity in the air supply within that air cell or mattress section to a blower or regulating valve to increase air supply.

One particular embodiment provides a therapeutic mattress for controlled support of a patient, the mattress comprising at least one inflatable chamber having a first translucent portion for the introduction thereto of light energy and a second translucent portion for the passage therethrough of light energy; a source of light energy adapted to introduce light energy through the first translucent portion into the interior of the inflatable chamber; and a receiver of light energy adapted to receive light energy through the second translucent portion from the interior of the inflatable chamber, the receiver being adapted to generate a signal indicative of the quantity of light so received. The first and second translucent portions are preferably disposed on opposing sides of the inflatable chamber. The inflatable chamber also has one or more pouches to secure the source and/or the receiver to the chamber. Preferably, the pouch also has a releasable closing to facilitate insertion and removal of the source and/or receiver. The pouch optionally also has an opaque portion to conceal the source and/or receiver secured within the pouch and a reflective portion to facilitate the transfer of light energy through the chamber. Cushioning material, such as foam, plastic, or cloth batting, is optionally disposed within the inflatable chamber to provide extra support cushioning to the patient. The chamber optionally also includes an air permeable portion to facilitate a gradual flow of air out of the chamber, and a water permeable portion to draw moisture away from the patient.

Another embodiment provides a therapeutic mattress for controlled support of a patient, the mattress comprising a plurality of inflatable chambers each having a light-scattering inner surface; a first of the inflatable chambers having a first light emitter and a first light detector; a second of the inflatable chambers having a second light emitter and a second light detector; and first and second pouches adjacent opposite sides of each of the first and second inflatable chambers. The first light emitter is disposed within the first pouch of the first chamber and is adapted to introduce light energy, preferably infrared light, into the interior of the first chamber. The first light detector is disposed within the second pouch of the first chamber and is adapted to receive light energy from the interior of the first chamber and generate a signal indicative of the quantity of light energy received. The second light emitter is disposed within the first pouch of the second chamber and is adapted to introduce light energy into the interior of the second chamber. The second light detector is disposed within the second pouch of the second chamber and is adapted to receive light energy from the interior of the second chamber and generate a signal indicative of the quantity of light energy received. Furthermore, the mattress is provided with a source of pressurized fluid in communication with the first and second inflatable chambers, the source being adapted to control inflation of the first chamber according to the signal generated by the first light detector, the source being further adapted to control inflation of the second chamber according to the signal generated by the second light detector. Inflation of the first and second inflatable chambers is controlled to minimize interface pressures between the therapeutic mattress and a patient lying on the mattress while simultaneously maintaining sufficient air pressure to prevent the inflatable chambers form bottoming out.

Other embodiments may include other distance sensing mechanisms either alone or in combination with the heterodyning proximation detector, force-responsive distance sensing apparatus or the light-responsive distance sensing apparatus, adapted to assist in controlling and monitoring the air supply of the mattress.

The invention may take the form of a method for regulating inflation within a mattress assembly or overlay. Such a method can be used to better accommodate a wide range of patient body sizes. The preferred method includes the following steps:

1. deflating the mattress and measuring and storing the height distance from a heterodyning proximation detector to a patient while the mattress is deflated;
2. initiating inflation of the mattress as the patient nears the heterodyning proximation detector;
3. placing the patient on the mattress and continuing to increase the air supply of the mattress until fully inflated.
4. measuring and storing the output signal or signals from the heterodyning proximation detector, force-responsive distance sensing apparatus, light-responsive distance sensing apparatus, or any combination of these while the mattress is fully inflated with a patient on top of the mattress;
5. calibrating the optimal height distance for that particular patient using the stored signals from the deflated and fully inflated positions;
6. monitoring and controlling air supply to the mattress based on the determined optimal height distance using the heterodyning proximation detector, force-responsive distance sensing apparatus, light-responsive distance sensing apparatus, or any combination of these.

Among those benefits and improvements that have been disclosed, other objects and advantages of this invention will become apparent from the following description taken in conjunction with the accompanying drawings. The drawings constitute part of this specification and include exemplary embodiments of the present invention and illustrate various objects and features thereof.

BRIEF DESCRIPTION OF THE DRAWINGS

FIG. 7 shows the deformation of an air cell's initial shape in response to compressive forces exerted by a patient when positioned on the mattress.

DETAILED DESCRIPTION OF THE PREFERRED EMBODIMENTS

As required, preferred embodiments of the present invention are described herein; however, the disclosed embodiments are merely exemplary of the invention that may be embodied in various forms. The figures are not necessarily to scale; some features may be exaggerated to show details of particular components. Specific structural and functional details disclosed herein are therefore not to be interpreted as limiting, but as a basis for the claims and as a representative basis for teaching one skilled in the art to variously employ the present invention.

Figure 1:
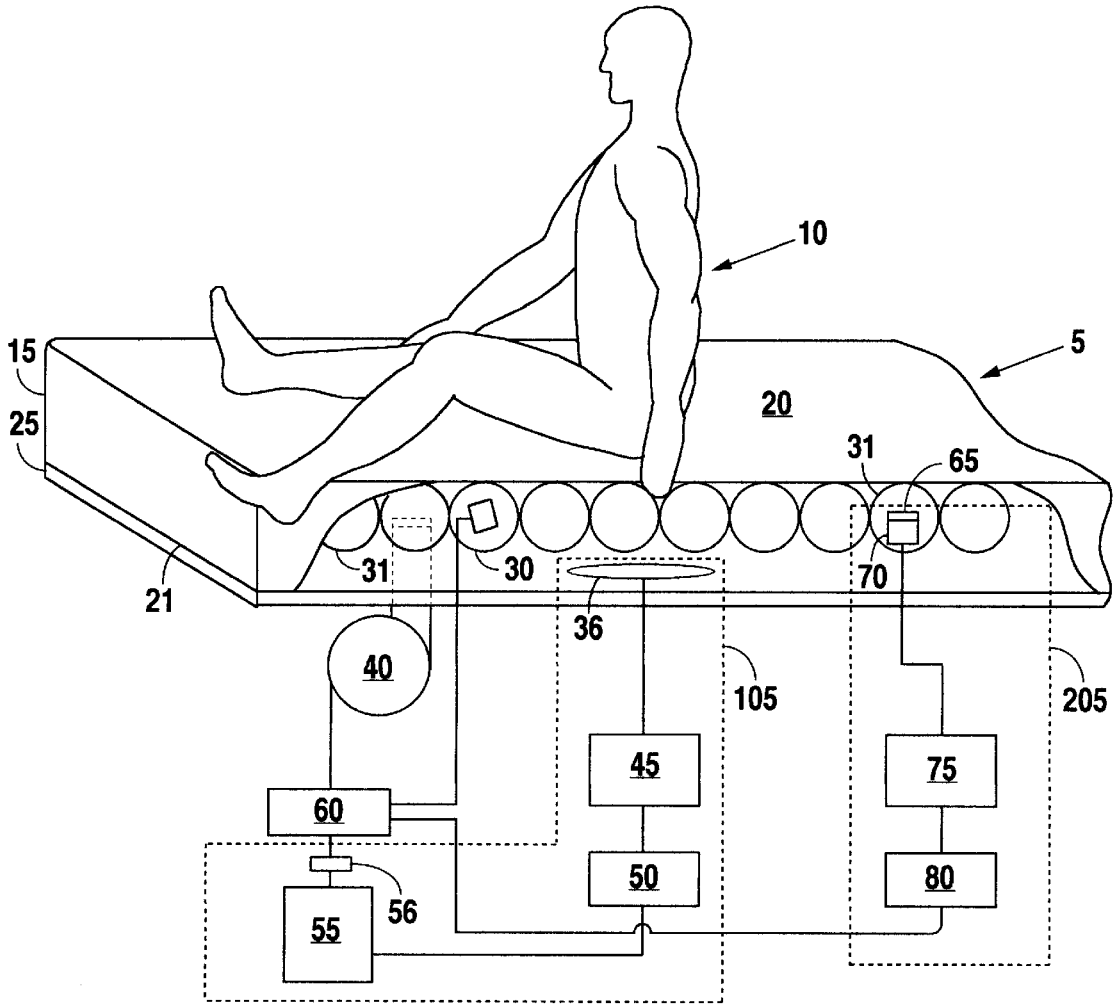
FIG. 1 is a perspective, partially cut away, view of the present invention, an apparatus for sensing patient distance, and all of its components.
Figure 2:
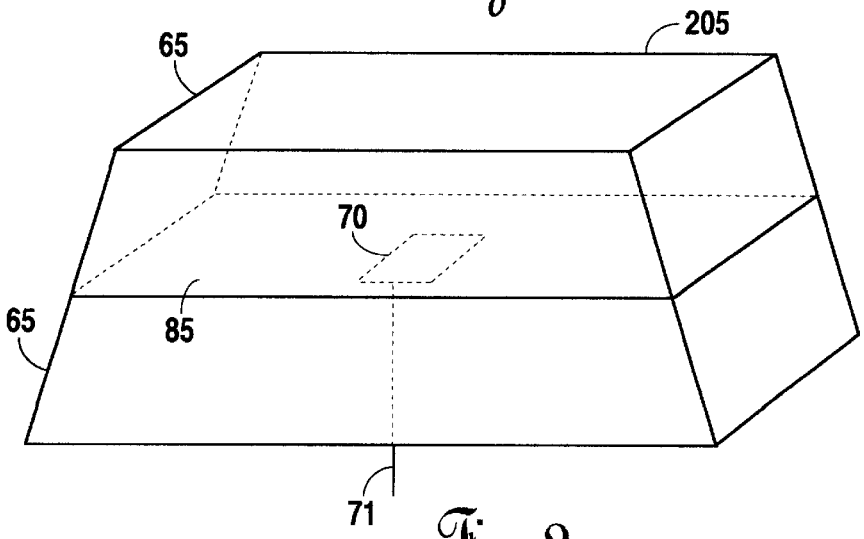
FIG. 2 is a perspective view showing one possible arrangement of a force-responsive distance sensing apparatus have a force sensing element set within a force transmitting member, shown here as a cushion. A heterodyning proximation detector is also set within the force transmitting member and is working in cooperation with the force-responsive distance sensing apparatus.
Figure 3:
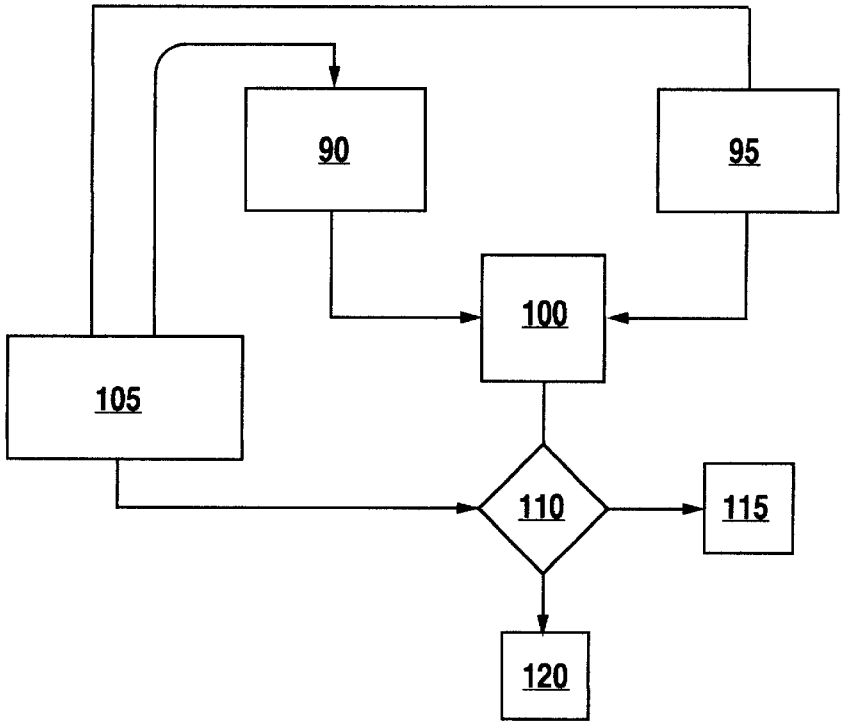
FIG. 3 is a schematic illustration of one method for regulating the inflation of the air mattress with the apparatus shown in FIG. 1.
Figure 4:
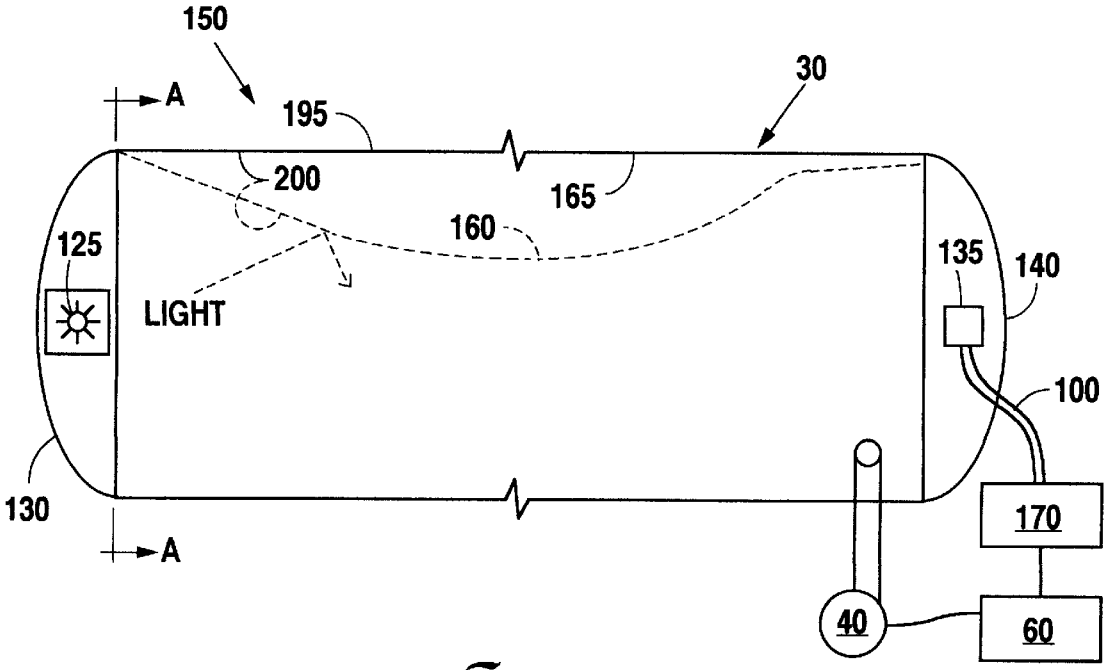
FIG. 4 is a perspective view showing one arrangement of a light-responsive distance sensing apparatus through the use of light emission and detection.
Figure 5:
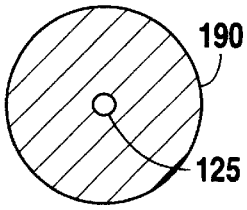
FIGS. 5 and 6 are cross sectional and side views, respectively, of an alternative arrangement of a self-inflating air cell apparatus where light is emitted through a translucent outer surface of the air cell.
Figure 6:
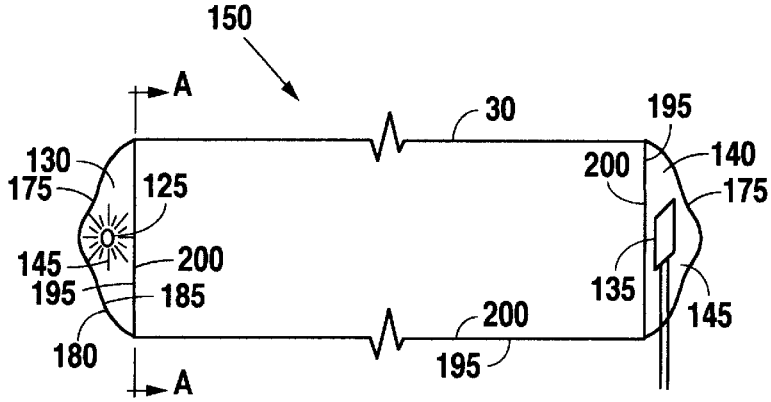

Referring to the drawings, at least one embodiment of the apparatus and one method of the present invention may be appreciated for sensing patient distance. FIG. 1 shows the preferred embodiment of an apparatus for sensing patient distance 5 where a force-responsive distance sensing apparatus 205 having a force sensing element 70 coupled to a force transmitting member 65 is functionally cooperating with a heterodyning proximation detector apparatus 105, and a light-responsive distance sensing apparatus 30 to regulate the air pressure within an air mattress 15 accordingly. FIG. 2 illustrates one embodiment of a force-responsive distance sensing apparatus 205 comprising a force sensing element 70 horizontally positioned within a force transmitting member 65. FIG. 3 illustrates a preferred method for regulating the air flow of an air mattress 15 using data obtained from a heterodyning proximation detector apparatus 105. FIG. 4 features one embodiment of a light-responsive distance sensing apparatus 30 comprising a light emitter 125 and a light detector 135 positioned at the opposing ends of a deformable inflatable chamber 150. FIGS. 5 and 6 illustrates an alternative embodiment of a light-responsive distance sensing apparatus 30 incorporating a pliable covering 175 to cover and secure the light emitter 125 and the light detector 135 to the chamber 150. FIG. 7 shows various exemplary deformation configurations to which a light-responsive distance sensing apparatus 30 might be subjected. With reference to each of these illustrated embodiments, however, it should be understood by those ordinarily skilled in the art that various other apparatus and methods could be incorporated without departing from the scope of the present invention.

Referring to FIG. 1, there is shown a patient 10 positioned partially atop an apparatus for sensing patient distance 5 above a patient support surface. As shown, an apparatus for sensing distance 5 of the present invention includes an air mattress 15 which defines a patient support surface, and is preferably supported by a conventional bed frame 25. Frame 25 typically comprises more than one articulatable section, and is preferably mounted on castors for ease of movement in the hospital environment. To rotate or elevate the patient thereon, frame 25 may include hydraulic lifting mechanisms for raising and lowering portions of the frame 25, including the articulatable sections of the frame 25. Frame 25 may further be constructed of radiolucent materials, such as LEXAN, that are ideally suited for taking x-rays. A preferred air mattress 15 includes a series of air cells 31 which define an upper surface 20 and a lower surface 21 of the air mattress 15. In its preferred embodiment, patient 10 primary support and cushioning is provided by a series of air cells 31, however, the present invention is operable with an air mattress 15 comprising a single air cell 31. The upper and lower surfaces 20, 21 may be constructed of water permeable material which acts to draw moisture away from the patient 10 and, thus, assist in maintaining a sanitary environment. For therapeutic purposes, air cells 30, 31 can be constructed using an air permeable material to facilitate a gradual flow of air through the upper and lower surfaces 20, 21 of each air cell 30, 31, and thereby provide patient 10 with an air mattress 15 having a preferred therapeutic air pressure. In accordance with the present invention, each air cell 30, 31 receives inflation pressure from at least one blower 40 that is connected thereto by a fluid conduit, not shown, or the like.

FIG. 1 illustrates a preferred embodiment of the present invention featuring a heterodyning proximation detector apparatus 105; a force-responsive distance sensing apparatus 205; and a light-responsive distance sensing apparatus 30. As shown, the force-responsive distance sensing apparatus 205 includes a force transmitting member 65 and force sensing element 70 contained within at least one air cell 31. A force transmitting member 65 is preferably constructed of a complaint cushioning material such as, but not limited to, foam, plastic or cloth batting. As will be appreciated, the force transmitting member 65 provides the present invention with a two-fold effect. First, the force transmitting member 65 defines an element of the force-responsive distance sensing apparatus 205 for detecting changes in the height of the upper surface 20 relative to the lower surface 21 as a patient is positioned atop the air mattress 15. More particularly, changes in the patient 10 distance relative to the lower surface 21 are detected in real-time via a force sensing element 70 which measures a variable range of compressive forces exerted by the force transmitting member 65 in response to the compressive forces of a patient 10 resting thereon. Second, the thickness of the force transmitting member 65 provides an air mattress 15 with extra support cushioning in the event air mattress's 15 inflation pressure is reduced below that required to prevent the patient from bottoming-out, thus reducing the risk for patient injury.

FIG. 2 illustrates the preferred spatial relationship between the force sensing element 70 and the force transmitting member 65 of the force-responsive distance sensing apparatus 205. As shown, the force sensing resistor 70, which might be a force-sensitive resistor, piezoelectric crystal, or the like, is coupled to the force transmitting member 65 along a horizontal plane 85; however, situating such sensors on other spatial planes is contemplated as well. As will be understood be one skilled in the art, the force transmitting member 65 can be formed using a multiplicity of segmented members, which may differ in size and shape, to allow cooperative ease of movement in tandem with the air mattress 15. Moreover, at least one force sensing element 70, which transfers the signal through the control wire 71, may be coupled to at least one segmented force transmitting member 65 or throughout a non-segmented force transmitting member 65 to provide an array of sensors suited for detecting compressive forces from various parts of the body. The force sensing element 70 may also be placed and coupled to the either the upper or lower surface of the force transmitting member 65, within the force transmitting member 65, or generally wherever the height of the patient above the frame 25 is desired to be known. Further illustrated in FIG. 2 is an embodiment of the force transmitting member 65 configured as a trapezoidal prism. It should be understood that other configurations can be used without departing from the scope of the invention. Other chosen configurations, however, should facilitate patient comfort, support and stability.

As can be appreciated from FIG. 1, compression of the force transmitting member 65 generates a resulting voltage across the force sensing element 70 which is representative of the compression exerted on the force sensing element 70 by the force transmitting member 65. Following compression of the force transmitting member 65, the resulting voltage is delivered to a controller 75 where the received voltage is compared to a preset calibrating signal. Deviations in the voltage signal as compared to the preset calibrating signal are then directed across a buffer amplifier 80 which modifies the voltage signal into a speed control voltage. The speed control voltage is then directed to a blower 40 or fluid regulating valve thereby either increasing or decreasing the rate of inflation air into the air mattress 15. Controller 75 can also be configured to communicate with a microprocessor 60 which stores and compares various voltage values, and is operable to regulate blower 40 or fluid regulating valve in response to changes in patient height distance.

As shown schematically in FIG. 1, a heterodyning proximation detector apparatus 5 includes an antenna 36 connected to a tank circuit and oscillator mock-up 45 which is in communication with detector 50. In its preferred embodiment, tank circuit and oscillator mock-up 45 comprises a capacitor and variable inductor operatively connected to a frequency oscillator. Frequency signals received by detector 50 are sent through a low pass filter 55 which operates to filter out high frequency signals, and emit only low frequency signals for conversion by a frequency-to-voltage converter 56. The frequency-to-voltage converter 56 transforms the low frequency signals into a speed control voltage which activates a blower 40 or fluid regulating valve to provide inflation pressure to the air mattress 15. Detector 50 may also be configured with a microprocessor 60 for storing and comparing various voltage values to provide blower 40 speed control.

In use, the heterodyning proximation detector apparatus 5 detects interactions between the electrical field pattern of the antenna 36 and the patient's 10 electrical signature which is characteristic of that patient's 10 dielectric constant. More particularly, the tank circuit and oscillator mock-up 45 operates to induce an electrical field within the antenna 36 which is responsive to a patient's 10 electrical signature characterized by the particular dielectric constant of that patient. Upon interaction with antenna's 36 induced electrical field, a resulting change in the natural frequency of the oscillator is detected. The altered frequency is sent to detector 50 which functions to compare the altered frequency to a preset reference frequency. Detected alterations in frequency signals are then transmitted through a low pass filter, and the resulting difference frequency is sent to a frequency-to-voltage converter 56 and/or servo control circuit which, in turn, communicates a generated speed control voltage to a blower 40 or fluid regulating valve.

The generated heterodyning proximation detector frequency is compared to a frequency generated by a calibrating tank circuit and oscillator for any deviations between the two frequencies via a product detector 50. A deviation in frequency represents any change in the patient's relative position from the heterodyning detector apparatus 105 as compared to the calibrating, optimal therapeutic air pressure for the air mattress 15. The deviation frequency from the product detector 50 is sent through a low pass filter 55 to allow only low frequency signals to pass as preparation for entering through a frequency-to-voltage converter 56.

The preferred method for regulating the inflation of an air mattress 15 of the present invention is shown in FIG. 3. Initially, air mattress 15 is set to a deflated position 90. While in a deflated position 90, a patient is furthest away from the antenna 36 and air mattress 15. Referring to FIG. 3, the antenna 36 and air mattress 15 are collectively depicted as the heterodyning proximation detector apparatus 105; thus, data representing the distance where the patient is furthest away from the heterodyning proximation detector apparatus 105 is recorded at the deflated position 90. As the patient approaches the antenna 36, the heterodyning proximation detector apparatus 105 detects the patient and signals blower 40 to begin delivering inflation pressure to the air mattress 15. This step enables a sufficient amount of inflation pressure to be delivered into the air mattress 15 so as to inflate the air mattress 15 and prevent the possibility of patient bottoming-out as the patient is positioned atop the air mattress 15. The air mattress 15 continues to inflate to a fully inflated position 95 so long as the patient remains positioned atop the upper surface 20 of the air mattress 15. After the air mattress 15 reaches a fully inflated position 95, data representing the patient's closest distance away from the heterodyning proximation detector apparatus 105 is recorded. The patient's optimal height distance 100 is then calibrated using the stored distances from the deflated and fully inflated positions 90, 95 which are based upon the individual's reactance as detected by the heterodyning proximation detector apparatus 105. The air supply is continuously monitored and controlled 110 by the heterodyning proximation detector apparatus 105 to maintain the optimal height distance 100. As the patient's distance from the heterodyning proximation detector apparatus 105 increases or decreases, the air supply to the air mattress 15 is accordingly increased 115 or decreased 120 by control means specifically contemplated by this invention or the like. Additionally, other methods would provide a force-responsive distance sensing apparatus 205, a light-responsive distance sensing apparatus 30 or any other sensing means to cooperate and be included within the heterodyning proximation detector apparatus 105 to assist in controlling and monitoring the air supply of the air mattress 15.

FIG. 4 illustrates one embodiment of the light-responsive distance sensing apparatus 30 of the present invention. The light-responsive distance sensing apparatus 30 comprises at least one inflatable chamber 150 forming an outer chamber surface 195 and a sealed inner chamber surface 200. In a preferred embodiment, the inner chamber surface 200 is constructed of light diffusing materials, such as polyurethane, that are ideally suited to diffuse light within the inflatable chamber 150. Such inflatable chambers 150 may be arranged singularly, perpendicular to one another, in parallel or in any other preferred configuration that defines an inflatable air mattress 15 for providing primary cushioning and support. It is preferred that the inflatable chambers 150 be constructed of a flexible and pliable material that is receptive to a wide range of compressive forces, especially those forces generated by a patient positioned atop the upper surface 20 of the air mattress 15. Though other geometric shapes may be contemplated for the inflatable chamber 150, FIG. 4 depicts the chamber 150 as having a preferred cylindrical shape. As shown, the chamber 150 is constructed having a light emitter 125 releasably or permanently attached to the light emitter end 130 of the chamber 150 using fastening means, such as adhesives, tape, VELCRO, or any other fastening method known to one skilled in the art. A light detector 135 is attached to the light detector end 140 of the chamber 150 using the various fastening methods known in the art. The light emitter 125 and light detector 135 can be an infrared light emitting diode (IRLED) and a photo-transistor, respectively. However, it should be understood to someone skilled in the art that various other light emitters and detectors can be chosen without departing from the scope of the invention.

In use, the chamber 150 of the light-responsive distance sensing apparatus 30 is inflated to an initial preset shape 165, and the light emitter 125 and light detector 135 are activated to detect any deviation from the chamber's preset shape. As illustrated in FIG. 4, a chamber deformation 160 between the light emitter 125 and the light detector 135 is caused by compressive forces of the patient 10 when positioned on the upper surface 20 of the air mattress 15. As shown, chamber deformation 160 causes the inner chamber surface 200 to scatter the emitted light, and, thus, results in less emitted light being received and detected by the light detector 135. The resulting voltage output from the light detector 135 is transmitted through signal line 100 to a controller 170 which compares the light detector 135 voltage output to a preset calibrating voltage. Any deviation away from the preset calibrating voltage represents a material disparity in air supply within the monitored chamber 150. As shown in the embodiment of FIG. 4, a microprocessor 60 may be configured along with the controller 170 to store and compare the various voltage values. Where a material disparity in air supply is detected, the controller 170 and/or microprocessor 60 respond by delivering a voltage signal that activates a blower 40 or a regulating valve, not shown, to adjust the air supply accordingly.

FIGS. 5 and 6 refer to an alternative embodiment of the light-responsive distance sensing apparatus 30 constructed with a pliable covering 175. In this embodiment, the light emitter 125 and light detector 135 are situated outside of the outer chamber surface 195 at the light emitter end 130 and the light detector end 140, respectively. Other embodiments of the light-responsive distance sensing apparatus 30 position the light emitter 125 and light detector 135 within the chamber 150, embedded along the chamber's surface or any variation thereof. A pliable covering 175 having an inner surface 185 and an outer surface 180 is mated to the outer chamber surface 195 either along the entirety of the chamber 150 or substantially near the light emitter 125 or the light detector 135. As shown in FIG. 6, the pliable covering's inner surface 185 is mated to the outer chamber surface 195 forming a pouch 145 for receiving the light emitter 125 or the light detector 135 therein. In effect, the pouch 145 seals and secures the light emitter 125 and the light detector 135 to the chamber 150 by restricting relative movement therein; and the pouch 145, with its pliable covering, aesthetically conceals the light emitter 125 and the light detector 135. Additionally; the pouch 145 may be provided with releasable closings to facilitate either insertion or removal of the light emitter 125 or the light detector 135 into or out of the pouch 145 during maintenance or cleaning. FIGS. 5 and 6 show a chamber's surface which partially forms a pouch 190 as constructed of either transparent or translucent material to accommodate as well as modify the projection of light from the light emitter 125 to the light detector 135 through the chamber 150. To further facilitate the transmission of light through the chamber 150, the inner surface 185 of the pliable covering which partially forms the pouch 145 may be constructed of opaque or reflective material.

Figure 7A:
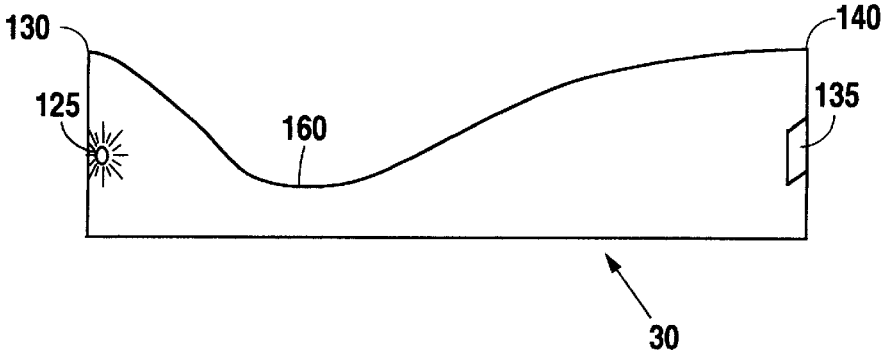
FIG. 7*a*. shows an air cell deformation toward one side of the air cell.
Figure 7B:
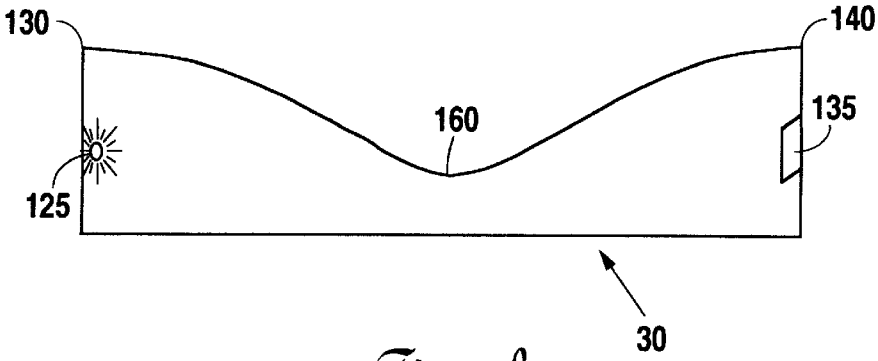
FIG. 7*b*. shows an air cell deformation toward the center of the air cell.

FIG. 7 shows in detail the chamber's deformation 160 in response to compressive forces exerted by the patient 10 when the patient 10 is resting on the upper surface 20 of the air mattress 15. FIG. 7*a*. shows a possible chamber deformation 160 towards the light emitter end 130. FIG. 7*b*. shows a possible chamber deformation 160 centered between the light emitter end 130 and the light detector end 140 of the chamber 150. Accordingly, one advantage of the present invention is that a deformation is detectable along the entire length of the light-responsive distance sensing apparatus 30, and, thus, precludes the need for a vast and costly array of sensors along the length of the chamber 150. As shown in FIGS. 4 and 5, the light emitter 125 and light detector 135 are preferably situated at the opposing ends of the cylindrical chamber 150. Positioning the chamber 150 transversely across the frame 25 thus enables the caregiver to obtain patient x-rays along the length of the air mattress 15 without any x-ray interference from the light emitter 125 and light detector 135.

While the description given herein reflects the best mode known to the inventor, those who are reasonably skilled in the art will quickly recognize that there are many omissions, additions, substitutions, modifications and alternate embodiments may be made of the teachings herein. Recognizing that those of reasonable skill in the art will easily see such alternate embodiments, they have in most cases not been described herein in order to preserve clarity.

What is claimed is:

1. A therapeutic mattress for controlled support of a patient, the mattress comprising:

at least one inflatable chamber having:

a pouch;

a first translucent portion for the introduction thereto of light energy; and a second translucent portion for the passage therethrough of light energy;

a source of light energy adapted to introduce light energy through the first translucent portion into the interior of the inflatable chamber; and a receiver of light energy adapted to receive light energy through the second translucent portion from the interior of the inflatable chamber, the receiver being adapted to generate a signal indicative of the quantity of light so received;

wherein the pouch secures at least one of the group consisting of the source and the receiver to the chamber.

2. The therapeutic mattress of claim 1, wherein the first and second translucent portions are disposed on opposing sides of the inflatable chamber.

3. The therapeutic mattress of claim 2, wherein the pouch has an opaque portion to conceal the at least one of the group consisting of the source and the receiver which is secured within the pouch.

4. The therapeutic mattress of claim 3, wherein the pouch has a reflective portion to facilitate the transfer of light energy through the chamber.

5. The therapeutic mattress of claim 1, wherein the pouch further comprises a releasable closing to facilitate insertion and removal of the at least one of the group consisting of the source and the receiver which is secured within the pouch.

6. The therapeutic mattress of claim 1, further comprising a source of pressurized fluid in communication with the inflatable chamber, the source being adapted to control inflation of the inflatable chamber according to the signal generated by the receiver.

7. The therapeutic mattress of claim 6, wherein the source is adapted to increase inflation of the inflatable chamber upon passage of said signal beyond a reference signal.

8. The therapeutic mattress of claim 1, further comprising cushioning material disposed within the inflatable chamber to provide extra support cushioning to the patient.

9. The therapeutic mattress of claim 8, wherein the cushioning material comprises at least one of the group consisting of foam, plastic, and cloth batting.

10. The therapeutic mattress of claim 1, wherein the chamber further comprises an air permeable portion to facilitate a gradual flow of air out of the chamber.

11. The therapeutic mattress of claim 1, wherein the chamber further comprises a water permeable portion to draw moisture away from the patient.

12. The therapeutic mattress of claim 11, wherein the chamber further comprises an air permeable portion to facilitate a gradual flow of air out of the chamber.

13. A therapeutic mattress for controlled support of a patient, the mattress comprising:

a plurality of inflatable chambers;

a first of the inflatable chambers having a first light emitter and a first light detector;

a second of the inflatable chambers having a second light emitter and a second light detector;

first and second pouches adjacent opposite sides of each of the first and second inflatable chambers;

wherein the first light emitter is disposed within the first pouch of the first chamber and is adapted to introduce light energy into the interior of the first chamber, and the first light detector is disposed within the second pouch of the first chamber and is adapted to receive light energy from the interior of the first chamber and generate a signal indicative of the quantity of light energy received;

wherein the second light emitter is disposed within the first pouch of the second chamber and is adapted to introduce light energy into the interior of the second chamber, and the second light detector is disposed within the second pouch of the second chamber and is adapted to receive light energy from the interior of the second chamber and generate a signal indicative of the quantity of light energy received; and a source of pressurized fluid in communication with the first and second inflatable chambers, the source being adapted to control inflation of the first chamber according to the signal generated by the first light detector, the source being further adapted to control inflation of the second chamber according to the signal generated by the second light detector;

wherein inflation of the first and second inflatable chambers is controlled to minimize interface pressures between the therapeutic mattress and a patient lying on the mattress while simultaneously maintaining sufficient air pressure to prevent the inflatable chambers from bottoming out.

14. The inflatable therapeutic mattress of claim 13, wherein each of the plurality of inflatable chambers has a light-scattering inner surface.

15. The inflatable therapeutic mattress of claim 14, wherein the light energy introduced into the first and second chambers comprises infrared light.

* * * * *